US010352012B2

(12) United States Patent
Irvine et al.

(10) Patent No.: US 10,352,012 B2
(45) Date of Patent: Jul. 16, 2019

(54) SHEET PILING AND INSTALLATION METHOD

(71) Applicant: CMI LIMITED CO., Marietta, GA (US)

(72) Inventors: John E. Irvine, Atlanta, GA (US); Steven E. Hargrave, Roswell, GA (US)

(73) Assignee: CMI LIMITED CO., Marietta, GA (US)

( * ) Notice: Subject to any disclaimer, the term of this patent is extended or adjusted under 35 U.S.C. 154(b) by 125 days.

(21) Appl. No.: 15/421,763

(22) Filed: Feb. 1, 2017

(65) Prior Publication Data

US 2017/0145649 A1 May 25, 2017

Related U.S. Application Data

(62) Division of application No. 14/202,112, filed on Mar. 10, 2014, now Pat. No. 9,593,456.

(60) Provisional application No. 61/781,332, filed on Mar. 14, 2013.

(51) Int. Cl.

| | |
|---|---|
| ***E02D 5/03*** | (2006.01) |
| ***E02D 7/00*** | (2006.01) |
| ***E02D 7/02*** | (2006.01) |
| ***E02D 5/12*** | (2006.01) |
| ***E02D 13/00*** | (2006.01) |

(52) U.S. Cl.

CPC ..... *E02D 5/03* (2013.01); *E02D 5/12* (2013.01); *E02D 7/02* (2013.01); *E02D 13/00* (2013.01); *E02D 2300/0007* (2013.01); *E02D 2300/0015* (2013.01); *E02D 2300/0029* (2013.01)

(58) Field of Classification Search

CPC ..... E02D 7/00; E02D 7/02
USPC ..... 405/274–280
See application file for complete search history.

(56) References Cited

U.S. PATENT DOCUMENTS

| | | | |
|---|---|---|---|
| 838,152 | A | 12/1906 | Williams |
| 3,333,431 | A | 8/1967 | Dougherty |
| 4,664,560 | A | 5/1987 | Cortlever |
| 4,690,588 | A | 9/1987 | Berger |
| 5,503,503 | A | 4/1996 | Glass et al. |
| 5,803,672 | A | 9/1998 | Glass et al. |
| 6,231,271 | B1 | 5/2001 | Glass et al. |
| 7,056,066 | B2 | 6/2006 | Irvine |
| 7,416,368 | B2 | 8/2008 | Dagher et al. |
| 7,914,237 | B2 | 3/2011 | Glass et al. |
| 7,999,691 | B2 | 8/2011 | Wolf et al. |
| 8,419,317 | B2 | 4/2013 | Irvine et al. |
| 9,593,456 | B2 | 3/2017 | Irvine et al. |

(Continued)

FOREIGN PATENT DOCUMENTS

| | | | |
|---|---|---|---|
| DE | 4442015 | A1 | 5/1996 |

*Primary Examiner* — Tara Mayo-Pinnock
(74) *Attorney, Agent, or Firm* — Gardner Groff Greenwald & Villanueva, PC

(57) ABSTRACT

A sheet piling for mandrel-installed engagement with an identical adjacent sheet piling. The mandrel has a guide hook and a rotating toe protector. The sheet piling has a female interlocking feature with a pair of hooks and an engagement hook for releasably engaging the mandrel guide hook. The sheet piling also has a male interlocking feature with a pair of hooks configured to engage the pair of female hooks of an adjacent sheet piling in a multi-piling wall structure.

10 Claims, 11 Drawing Sheets

(56) References Cited

U.S. PATENT DOCUMENTS

2010/0290843 A1* 11/2010 Irvine ..... E02D 5/02
405/274

* cited by examiner

SHEET PILING AND INSTALLATION METHOD

CROSS-REFERENCE TO RELATED APPLICATIONS

This application is a divisional of U.S. Non-Provisional patent application Ser. No. 14/202,112 filed Mar. 10, 2014, which claims the priority benefit of U.S. Provisional Patent Application Ser. No. 61/781,332 filed Mar. 14, 2013, which are hereby incorporated herein by reference.

TECHNICAL FIELD

The present invention relates generally to the field of sheet piling members, such as used in levees, flood walls, barrier walls, seawalls and other applications, and to improved methods of installation to form multi-piling walls and structures.

BACKGROUND

Sheet piling may be used in various applications, including without limitation, levee, barrier wall and seawall construction, environmental control, and other applications. Sheet piles can be formed of various materials, including without limitation, polyvinyl chloride (PVC), high-density polyethylene (HDPE), steel, or other materials. A mandrel system can be utilized for installation of sheet piles when the depth the pile is to be driven and/or the hardness of the soil or other substrate through which the pile is to be driven exceed the structural ability of the piling to resist deformation. U.S. Pat. Nos. 5,503,503, 5,803,672, 6,231,271, 7,056,066 and 7,914,237, and pending U.S. patent application Ser. Nos. 12/778,545 and 13/104,207, are incorporated by reference herein.

Occasionally, during installation, adjacent sheet pilings may separate and/or rotate into misalignment, allowing for increased potential lack of integrity of a piling wall system. Further, application of sealant to the joints between adjacent pilings may not be fully effective using known installation processes, potentially rendering the sealant ineffective. Additionally, confirmation of the integrity of attachment between installed pilings at depth for quality control purposes is limited with known products and installation methods. Accordingly, it can be seen that needs exist for improved sheet piling structures and to improved methods for installation of sheet pilings. It is to the provision of improved sheet piling systems and installation apparatus and methods meeting these and other needs that the present invention is primarily directed.

SUMMARY

In example embodiments, the present invention provides a sheet piling for mandrel-installed engagement with an adjacent sheet piling. The mandrel preferably includes a guide hook and a rotating toe protector. The sheet piling has a female interlock profile with a pair of hooks and an engagement hook for releasably engaging the mandrel guide hook. The sheet piling also has a male interlocking profile with a pair of hooks configured to engage the pair of female hooks.

In one aspect, the invention relates to a sheet piling installation system. The system preferably includes an installation mandrel comprising a substantially rigid elongate member having a top end, a toe end and first and second sides. The first side of the installation mandrel preferably includes an alignment hook extending longitudinally along at least a portion of its length, and the second side preferably includes a substantially enclosed channel extending longitudinally along at least a portion of its length, and further includes a toe plate pivotally mounted at the toe end for movement between a first position covering the toe end of the channel and a second position not covering the toe end of the channel. The system preferably also includes a sheet piling comprising a top end, a bottom end for driving into a substrate, leading and trailing sides, and a body configured to releasably mount onto the installation mandrel. The leading side of the sheet piling preferably includes an alignment flange for longitudinal sliding engagement with the alignment hook of the installation mandrel and a first coupling profile configured to be received within and slide longitudinally through the substantially enclosed channel of the installation mandrel. The trailing side of the sheet piling preferably includes a second coupling profile.

In another aspect, the invention relates to a sheet piling. The sheet piling preferably includes a body defining a top end, a toe end, a leading side and a trailing side. The sheet piling preferably further includes a mandrel alignment flange and a first coupling profile extending longitudinally along at least a portion of the leading side, and a second coupling profile extending longitudinally along at least a portion of the trailing side.

In still another aspect, the invention relates to a corner coupling for connecting a first sheet piling with a second sheet piling at an offset angle. The corner coupling preferably includes a first corner coupling profile for engagement with the first sheet piling member and a second corner coupling profile for engagement with the second sheet piling member.

In another aspect, the invention relates to an installation method for sheet pilings, comprising the steps of: mounting a first sheet piling to a mandrel; driving the first sheet piling into a substrate; removing the mandrel from the substrate leaving the sheet piling in place within the substrate; mounting a second sheet piling to the mandrel; engaging an alignment hook of the mandrel with an alignment flange of the first sheet piling; engaging a trailing edge coupling profile of the second sheet piling with a leading edge coupling profile of the first sheet piling; and driving the second sheet piling into the substrate with the trailing edge coupling profile of the second sheet piling remaining engaged with the leading edge coupling profile of the first sheet piling.

In another aspect, the invention relates to a reversible corner coupling for installation of a subsequently installed sheet piling member at an offset angle relative to an adjacent previously installed sheet piling member. The previously installed sheet piling includes a leading edge with a pair of coupling hooks and the subsequently installed sheet piling includes a trailing edge with a pair of coupling hooks. The reversible corner coupling includes a first coupling profile with a pair of first coupling hooks and a second coupling profile with a pair of second coupling hooks. The first coupling profile is oriented at an offset angle with respect to the second coupling profile. The first and second pair of coupling hooks are interengagable with the previously installed sheet piling leading edge coupling hooks and the subsequently installed sheet piling trailing edge coupling hooks.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

Figure 1:
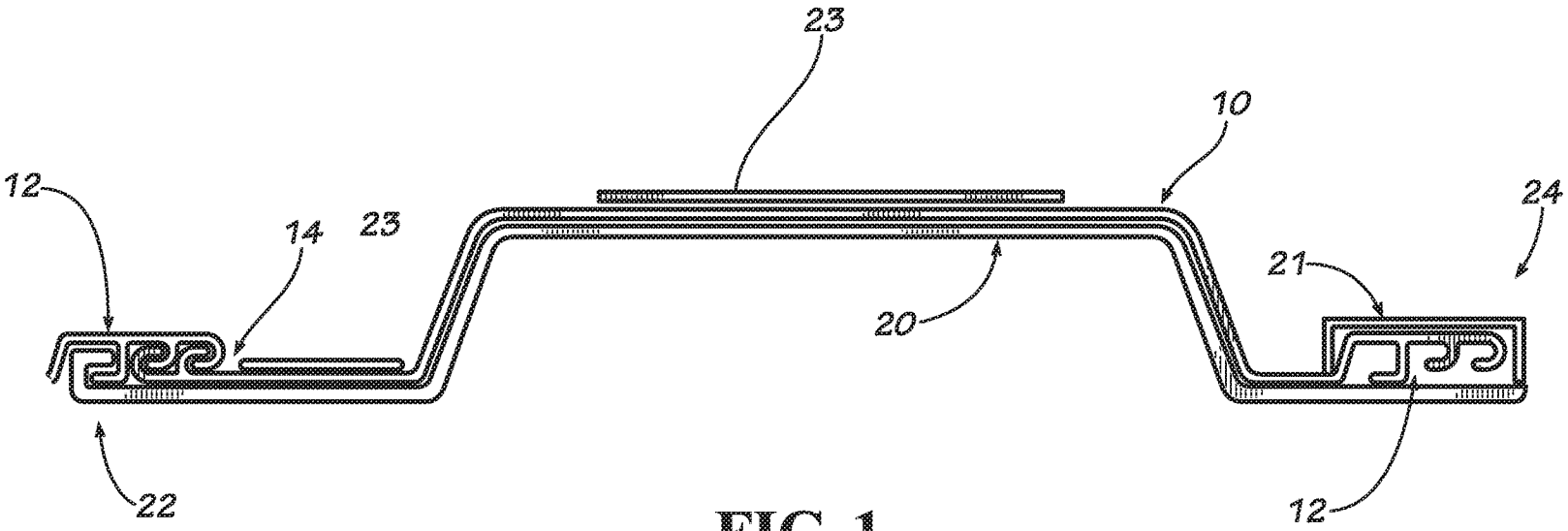
FIG. 1 is a cross-sectional view of a sheet piling carried on an installation mandrel and secured to a previously-driven sheet piling, according to example forms of the invention.
Figure 2:
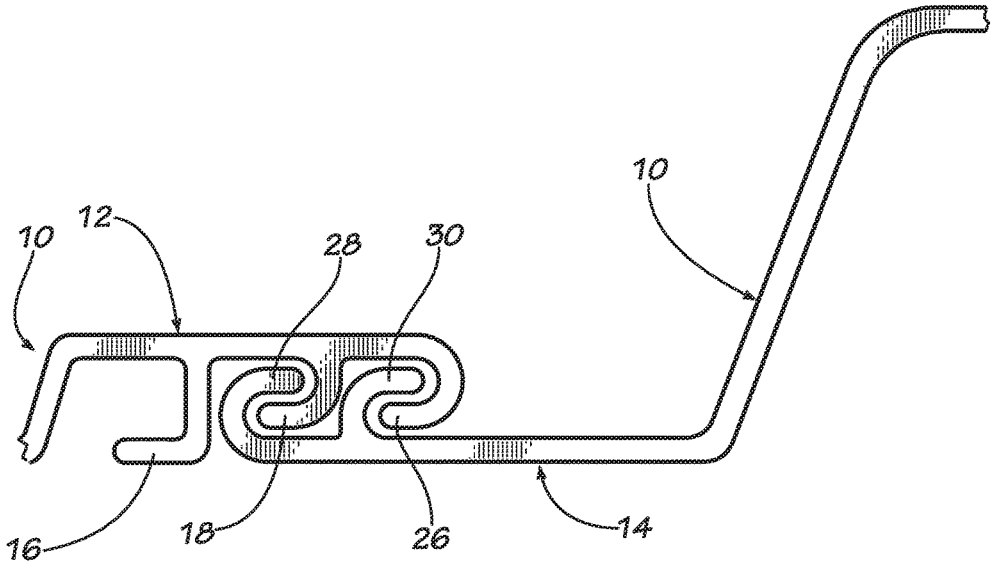
FIG. 2 is an enlarged sectional view of interconnecting male and female coupling profiles of adjacent sheet pilings shown in FIG. 1.
Figure 3:
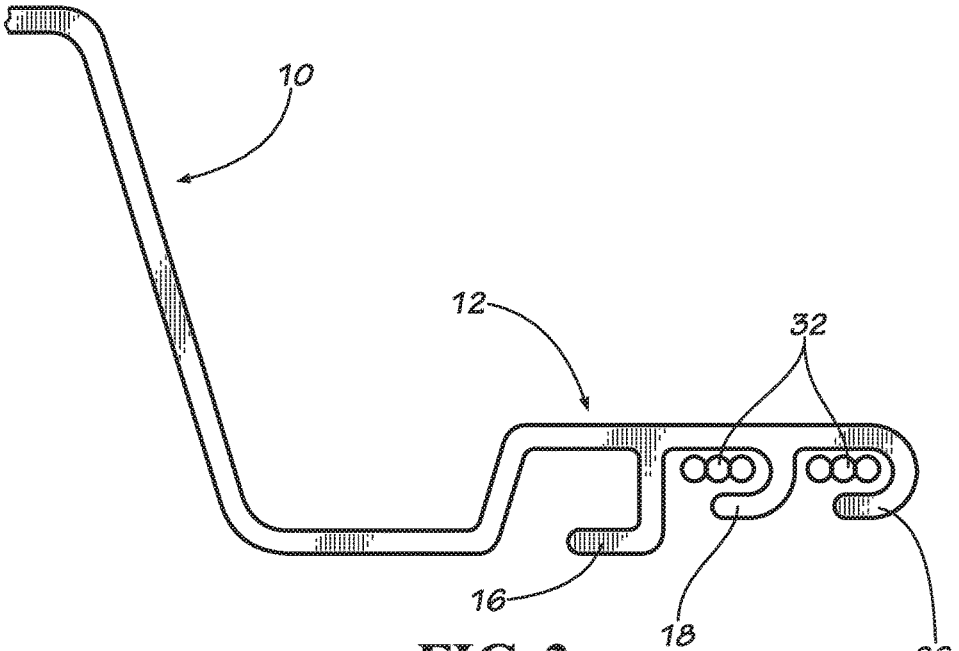
FIG. 3 is an enlarged isolated view of the coupling profile section of a sheet piling shown in FIG. 2, with sealant applied therein.
Figure 4:
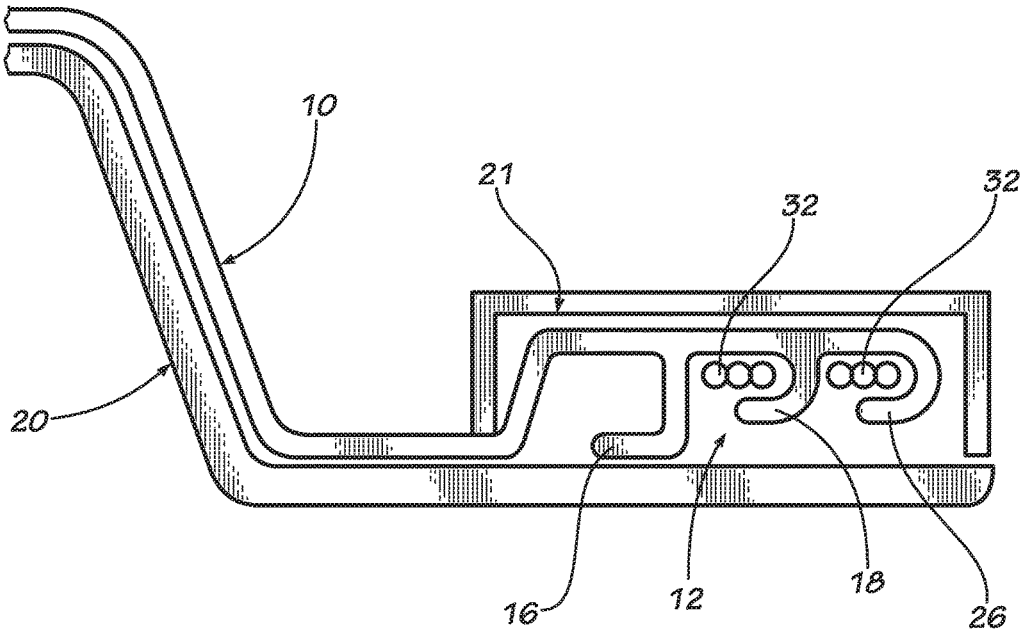
FIG. 4 is an enlarged sectional view of the sheet piling coupling profile from FIG. 1 as shown within the installation mandrel.
Figure 5:
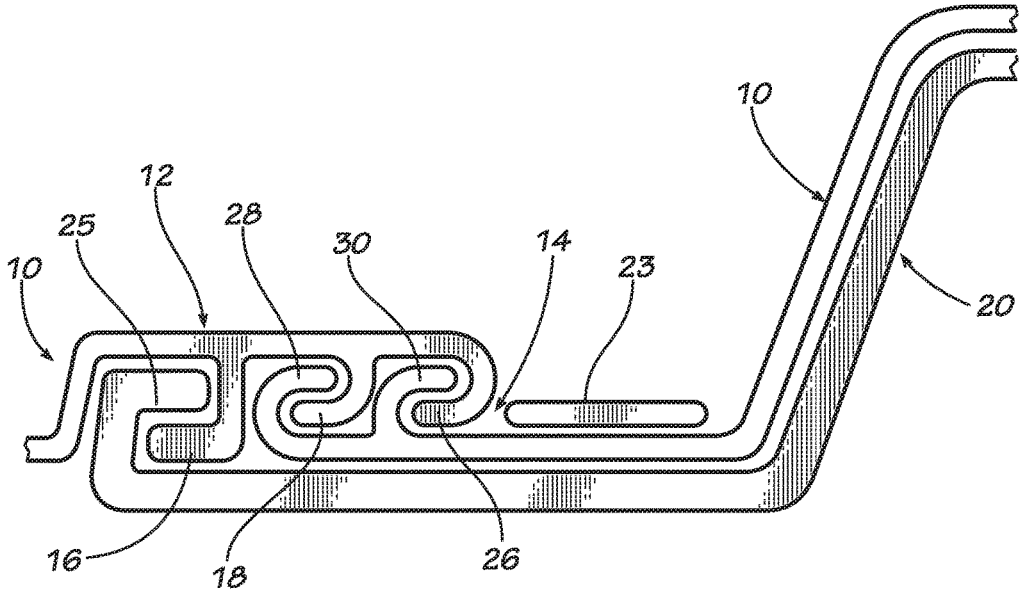
FIG. 5 is an enlarged sectional view of the interconnecting coupling profiles of adjacent sheet piling members during installation with a mandrel shown in FIG. 1.
Figure 6:
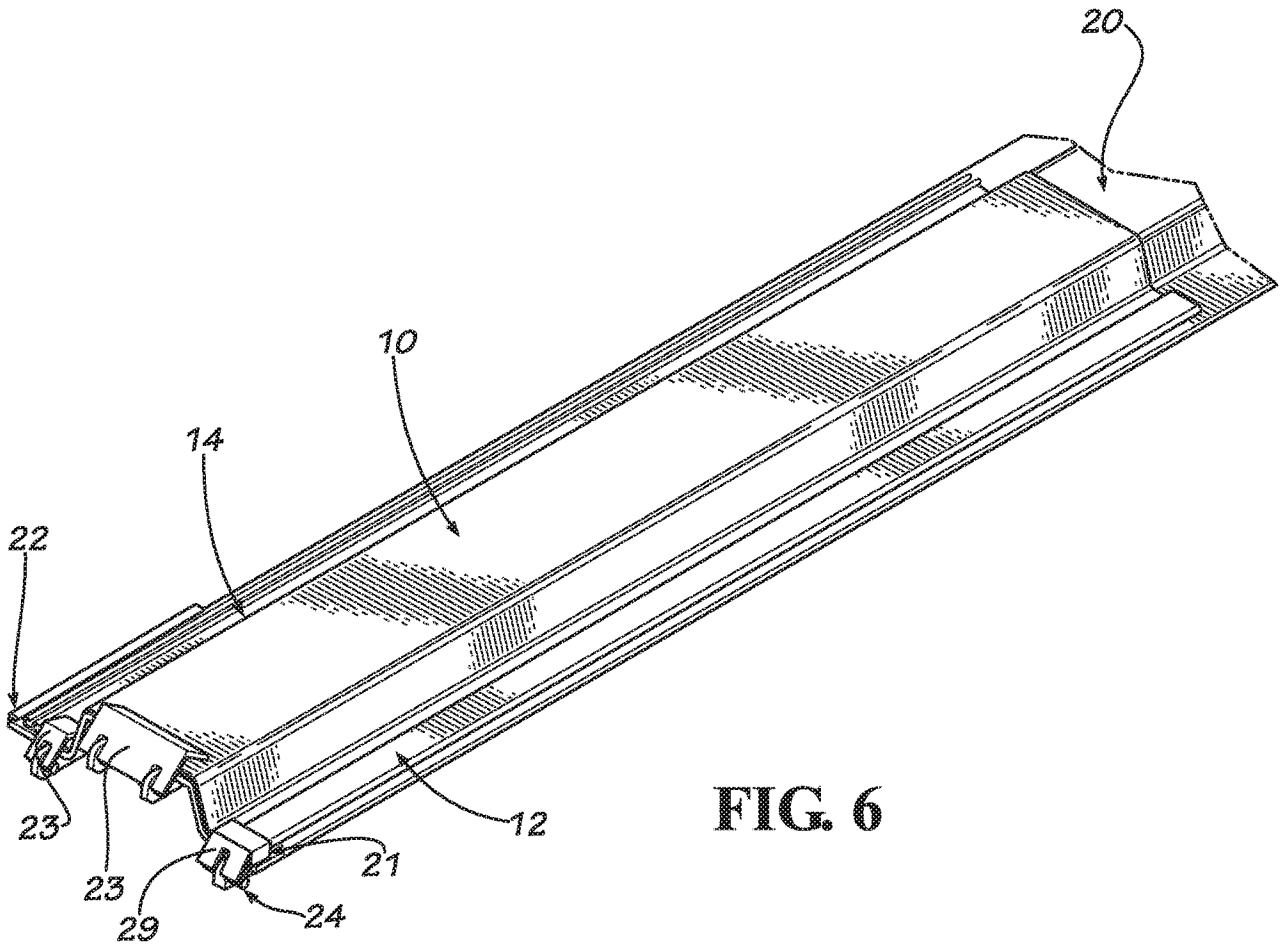
FIG. 6 is a perspective view of the sheet piling carried on the installation mandrel shown in FIG. 1.
Figure 7:
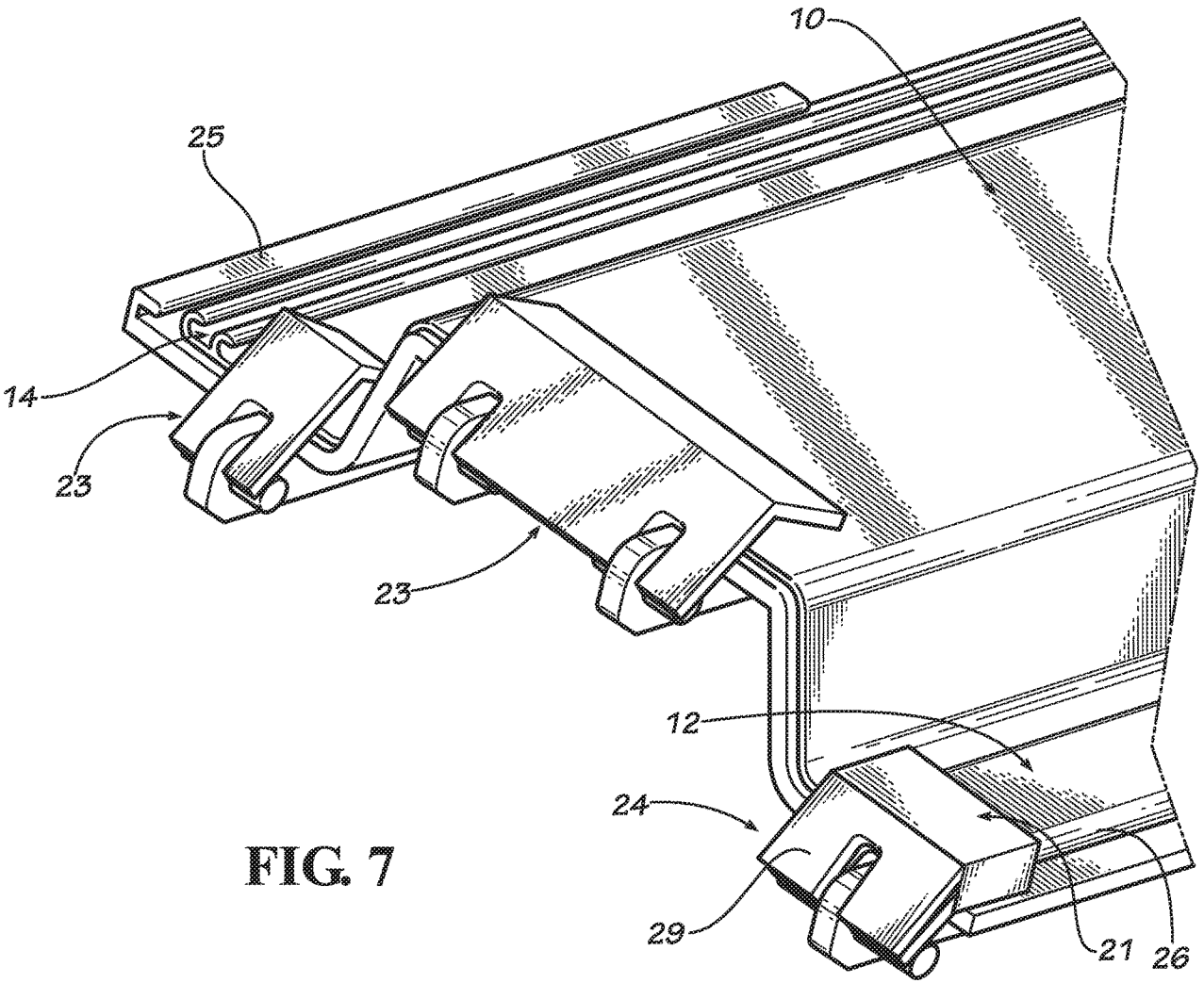
FIG. 7 is an enlarged perspective view of the sheet piling carried on the installation mandrel shown in FIG. 6 shown with the toe end in the closed driving position.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-12 show an improved sheet piling 10, which can be driven into a substrate (e.g., the earth) with a mandrel 20, according to an improved installation method. The mandrel 20 has dimensions and geometry that generally conform to the outer periphery of the sheet piling 10, to engage, shield and support the sheet piling as it is driven into the ground, and to ensure engagement and/or seal formation between adjacent sheet pilings in a piling wall.

Figure 8:
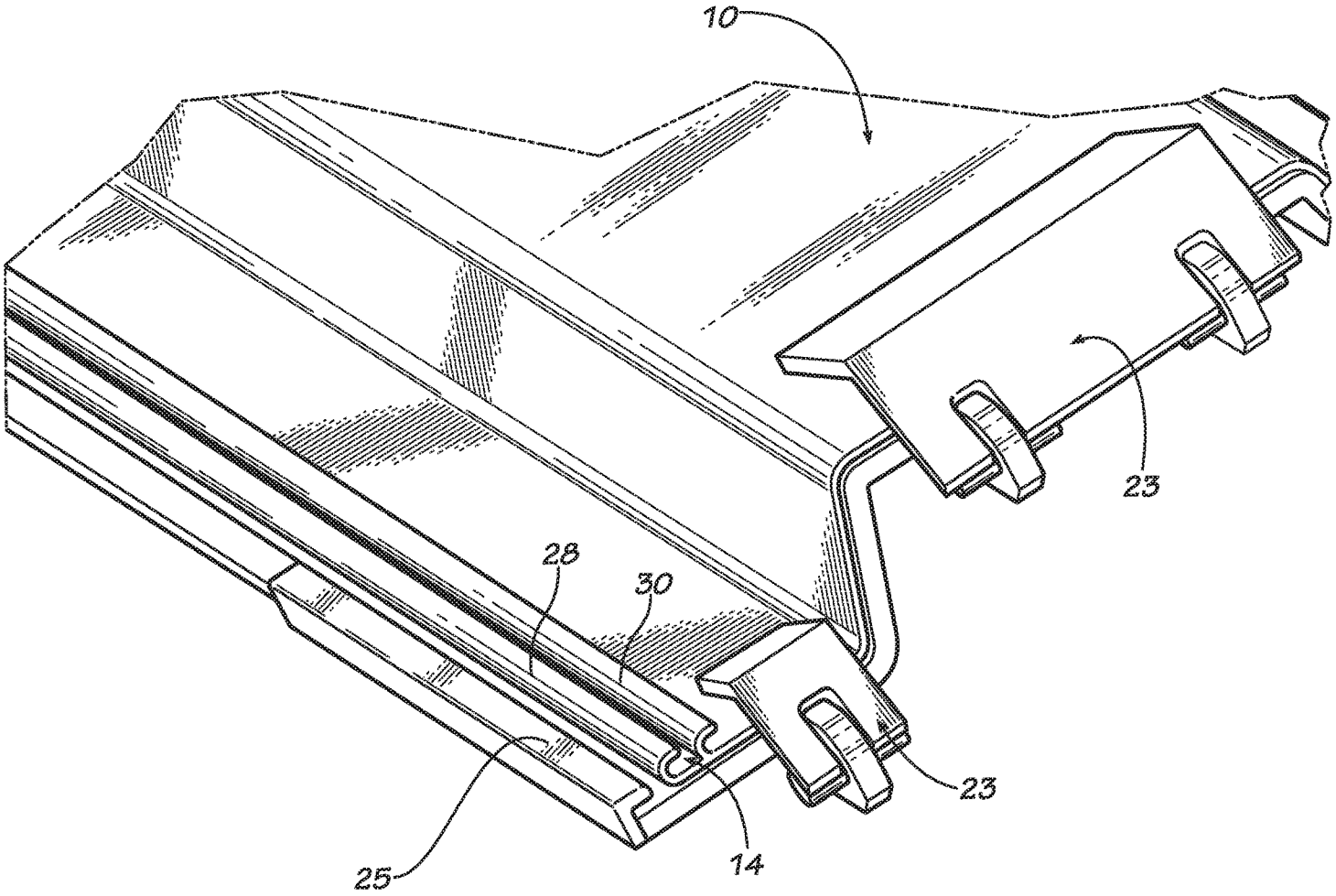
FIG. 8 is an enlarged perspective sectional view of the sheet piling carried on the installation mandrel shown in FIG. 6.
Figure 9:
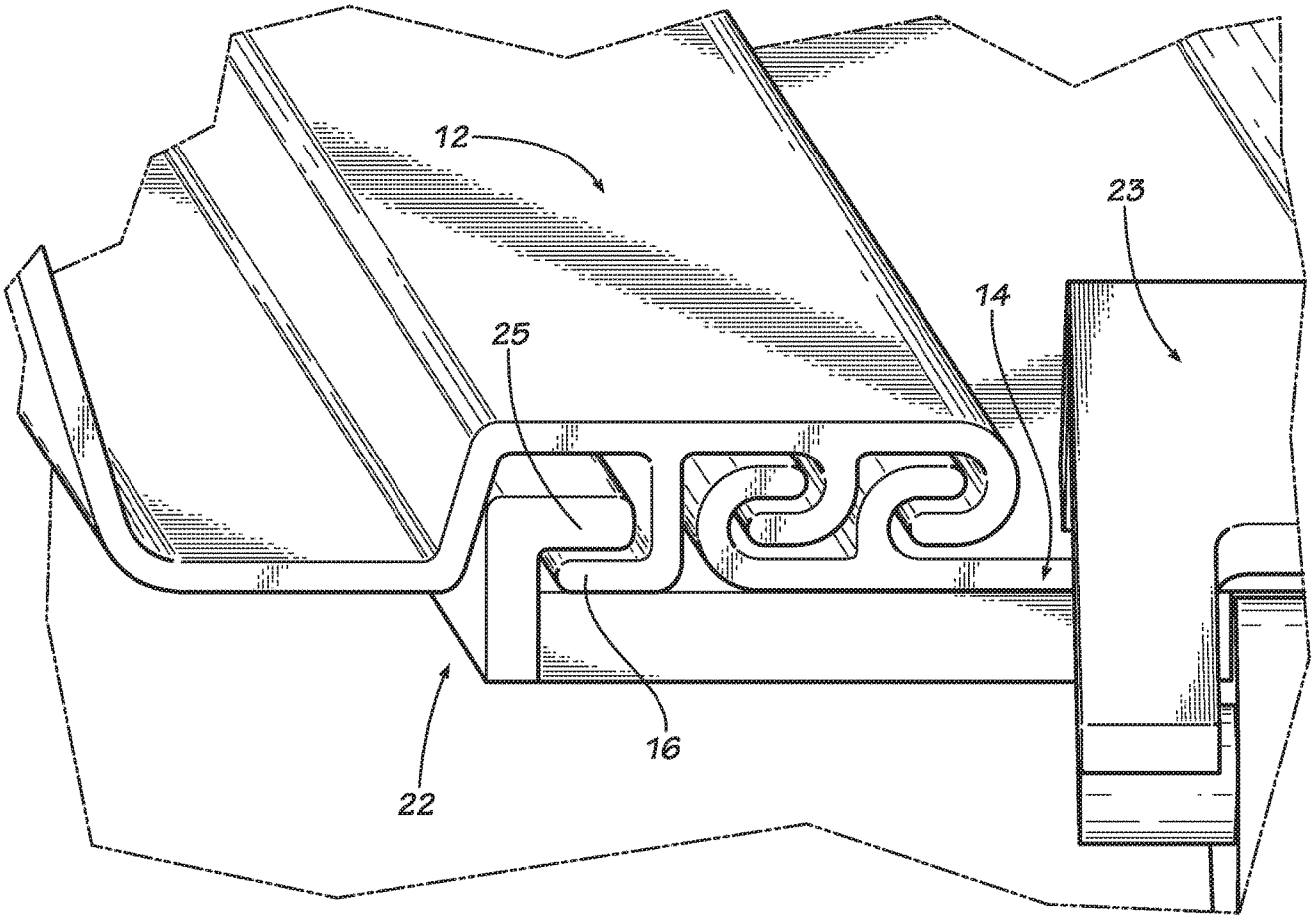
FIG. 9 is an enlarged perspective sectional view of the sheet piling carried on the installation mandrel shown in FIG. 6, and secured to a previously-driven sheet piling, as shown in FIG. 1.
Figure 10:
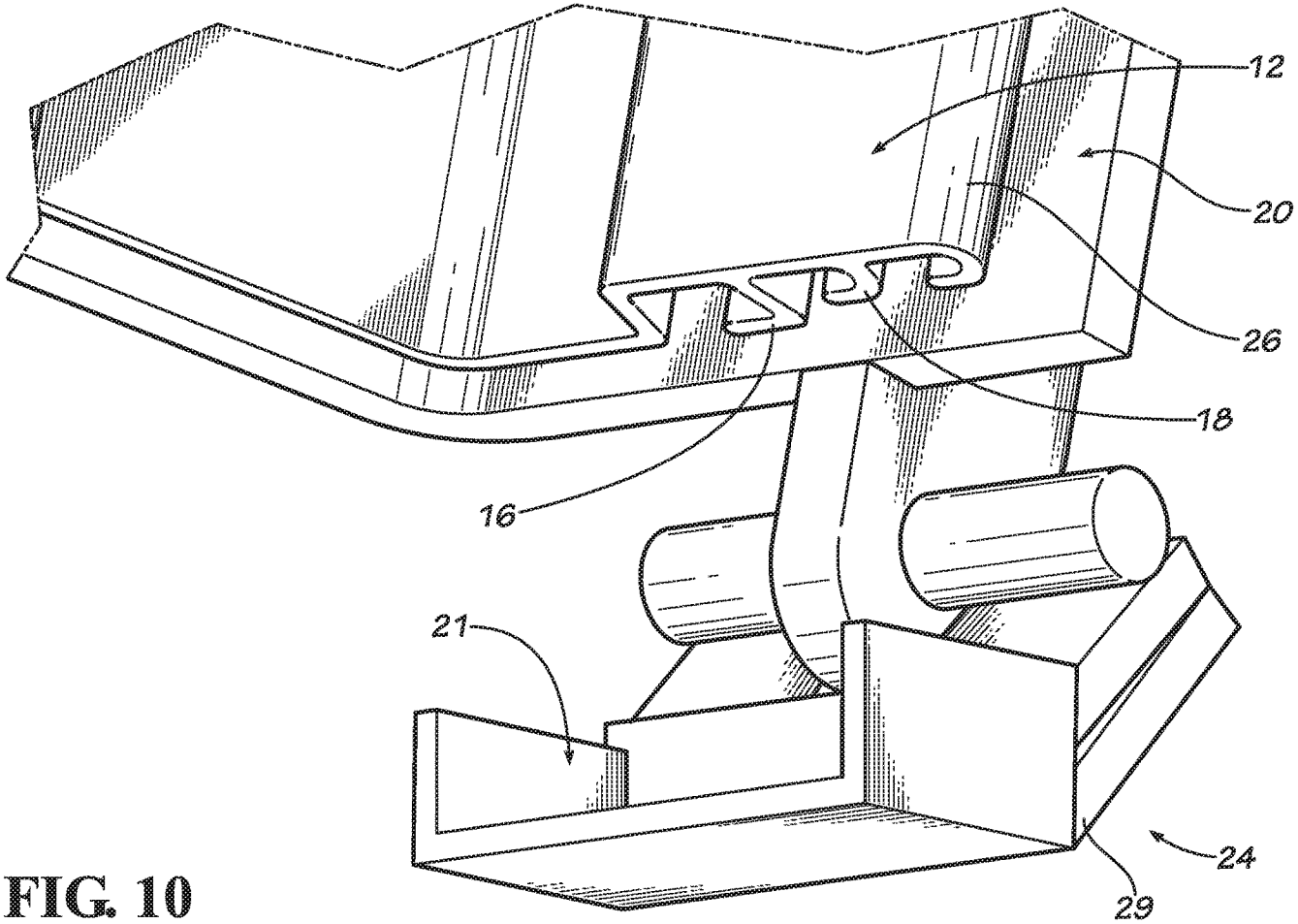
FIG. 10 is an enlarged perspective view of the sheet piling carried on the installation mandrel shown in FIG. 6 as shown with the toe guard in the open position.

The mandrel 20 is preferably fabricated from steel, iron or other substantially rigid structural material, and includes a top end and a bottom or toe end, and first and second sides, with the toe end adapted to be driven into the ground to a placement depth, and the top end operable for connection to an impact driver or other driving means. As particularly depicted in FIGS. 6-10, the toe edge preferably includes one or more hinged toe plate member(s) 23 that is/are pivotal between a first position overlying and protecting the leading edge of the sheet piling as it is driven into the ground during installation, and a second position allowing retraction of the mandrel from the ground after installation without displacing the sheet piling. As particularly shown in FIG. 9, the mandrel 20 preferably further comprises a first side 22 including an alignment flange or guide hook 25 for engagement with a cooperating alignment flange 16 of a previously-placed sheet piling adjacent the piling being installed by the mandrel, and a second side 24, particularly shown in FIG. 10, defining a substantially enclosed channel 21 for protecting a free side coupling profile of the sheet piling being placed. The leading edge of the channel 21 preferably includes a pivotal shield 29 or toe plate for protecting the leading edge of the sheet piling's coupling profile from the substrate during installation, and allowing removal of the mandrel without displacing the sheet piling after placement of the piling. During installation, the face of the pivotal shield 29 contacts the substrate and forces the toe plate 23 up into a closed position, as shown in FIG. 8. When the mandrel is pulled out of the substrate after installation, the channel 21 catches the substrate and pulls the toe plate 23 down and into an open position, as shown in FIG. 10.

The sheet piling 10 has a top end, a bottom end, first and second sides, and a body having front and rear surfaces. The body can define a generally C-shaped or D-shaped cross-sectional profile as depicted, or in alternate embodiments can define a generally flat panel profile, whereby a generally planar or corrugated wall structure is formed by assembly of multiple piling members. The sheet piling 10 includes interlocking male and female coupling profiles that extend along the length of each side edge so that a first sheet piling can secure to an adjacent second sheet piling, preferably substantially continuously and forming a fluid barrier seal therebetween, thereby forming a multi-piling wall structure. The sheet piling 10 is preferably a substantially rigid structural member formed of polyvinyl chloride (PVC), high-density polyethylene (HDPE), or other plastics, metals, ceramics or other materials.

The first or leading side 12 of the sheet piling 10 preferably includes a first coupling profile comprising a transversely or angularly offset web with the alignment flange 16 extending from a proximal portion thereof, and first and second coupling hooks or flanges 18, 26 extending from medial and distal portions thereof, respectively. In the depicted embodiment, the alignment flange 16 includes an upright leg and a transverse web extending generally perpendicular thereto, but in alternate embodiments may comprise an arcuate hook or other configuration suitable for engagement and retention with the alignment hook 25 of the mandrel. Alternatively, the leading side can have more than one alignment flange 16 and more than two coupling hooks or flanges 18, 26. The second or trailing side 14 of the sheet piling 10 preferably includes a first coupling hook or flange 28 at its distal edge for sliding engagement with the first coupling flange 18 of the leading side of an adjacent sheet piling, and a medial second coupling hook or flange 30 for sliding engagement with the second coupling flange 26 of the leading side of the adjacent sheet piling. Alternatively, the trailing side 14 can have more than one coupling hook or flange 28 and more than one medial coupling hook or flange 30.

The plural or multi-lock coupling profiles provide improved alignment and integrity between adjacent sheet piling members of a multi-piling structure, and greater resistance to lock disengagement or un-zipping during placement. The coupling profile at the leading edge 12 of the sheet piling is shielded during installation within the channel 21 of the mandrel to prevent damage to the coupling profile and also to plow a channel through the substrate. The trailing edge coupling profile 14 is shielded during installation within the leading edge coupling profile of the adjacent previously-installed sheet piling and the path through the substrate formed by installation of the previously-installed sheet piling. The coupling hooks of the sheet piling being installed are inwardly directed toward the center of the sheet piling, and are thereby better shielded by the mandrel during installation. The mandrel alignment flange 16 is positioned on the inner or proximal side of the coupling hooks 18, 26, and optionally has a higher profile than the coupling hooks for engagement with the mandrel guide hook 25.

As sequential sheet piling members of a multi-piling structure are installed, the dimensions, geometry and curvature of the coupling hooks 28, 30 of the trailing edge coupling profile 14 of the piling being installed slidingly engage with the coupling hooks 18, 26 of the leading edge of the adjacent, previously-installed piling. Optionally, a bead of sealant 32 is applied within the channel(s), defined by one or both of the leading edge coupling hooks 18, 26, prior to installing the piling 10. Various types of sealant 32 can be used, for example a polyurethane-based sealant and/or other sealant types. The protective channel 21 of the mandrel 20 protects the sealant 32 from the substrate during installation. When the next piling 10 is installed, the sealant 32 is extruded and distributed by the trailing edge coupling hooks 28, 30 to create a water-tight seal between the leading and trailing coupling profiles of adjacent pilings. This design ensures that sealant 32 is distributed along substantially the entire length of the adjoining coupling profiles at all levels of the engaged interlocking features. Any excess sealant forced out of the interengaging coupling profiles will tend to be displaced downwardly with the piling being installed, toward the bottom of the piling structure and around the seam between adjacent pilings, where resistance to fluid migration across the piling wall may be most needed.

During installation, the mandrel 20 is loaded with a first sheet piling 10 such that the sheet piling bottom edge is protected by the mandrel toe plate 23 and the leading edge coupling profile 12 is substantially enclosed within the protective channel 21. The mandrel 20 is then driven into a substrate, for example soil or slurry, with the toe end first. Once a sufficient depth is reached in the substrate, the rotating toe protector 23 pivots away from the piling and the mandrel is removed from the substrate. As a result, the first sheet piling remains within the substrate. A second sheet piling with substantially identical characteristics as the first sheet piling is then engaged with the mandrel 20 in the same manner as with the first sheet piling. As depicted, the mandrel guide hook 25 is engaged within the top of the first piling mandrel alignment hook 16, allowing the piling to slide relative to the mandrel in a lengthwise or longitudinal direction, but preventing lateral separation of the piling from the mandrel. At the same time, the toe end of the second sheet piling trailing edge coupling hooks 28, 30 are engaged within the top end of the first piling leading edge coupling hooks 18, 26. Then, similarly to the first sheet piling, the mandrel 20 is driven vertically downward into the substrate to the predetermined depth alongside the first piling. The mandrel guide hook 25 slides vertically downward along and within the first piling alignment hook 16, and the coupling hooks 28, 30 of the second piling slide vertically downward along and within the cooperating hooks 18, 26 of the first piling. The interlocking of the first piling's mandrel alignment hook 16 and the mandrel edge hook 25 prevent the mandrel from misaligning from the first piling when being driven into the substrate and help prevent separation or misalignment of the adjacent pilings.

Figure 11:
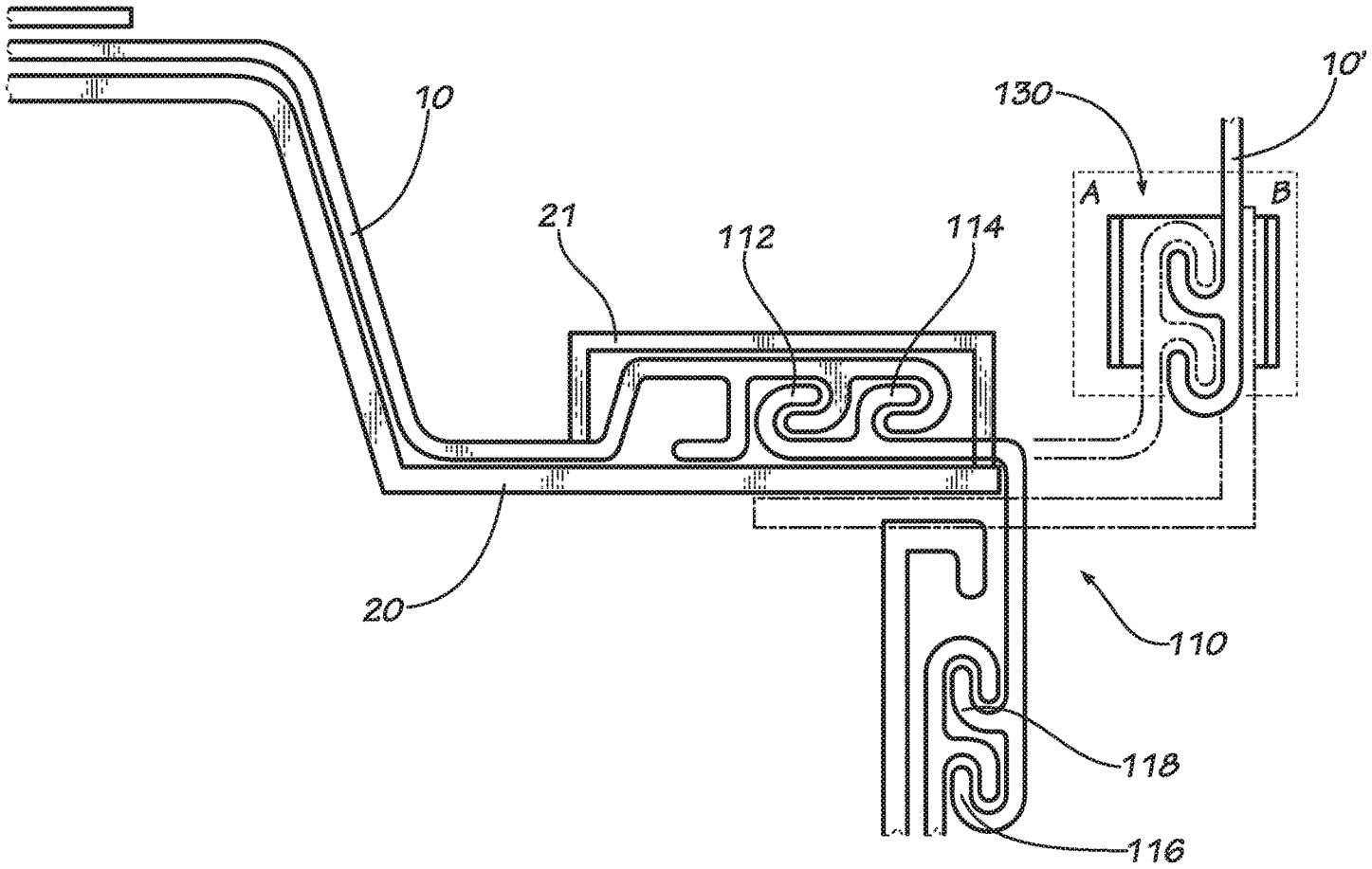
FIG. 11 is an enlarged sectional view of a corner coupling element for sheet piling members according to an example form of the invention

FIG. 11 shows a reversible corner coupling 110 for installation of a subsequently installed sheet piling member 10' at an offset angle relative to an adjacent previously installed sheet piling member 10. In the depicted embodiment, the corner coupling 110 includes a first coupling profile with a pair of first coupling hooks 112, 114, oriented at an offset angle of 90° to a second coupling profile with a pair of second coupling hooks 116, 118. In alternate embodiments, differing offset angles are provided, such as for example, 30°, 45°, 60° and 75°. The coupling hooks of the corner coupling 110 are interengagable with corresponding coupling hooks of the leading edge of the previously installed sheet piling 10 and the trailing edge of the subsequently installed sheet piling member 10' in similar fashion to that described above. The corner coupling 110 is reversible, with a first orientation shown in solid lines allowing formation of a "right-hand" corner in the multi-piling wall, and a second orientation shown in broken lines allowing formation of a "left-hand" corner. An angle iron mandrel is optionally provided for installation of the corner coupling 110 as depicted. The corner coupling 110 can incorporate sealant 32, similarly to the previously described embodiment.

Figure 12:
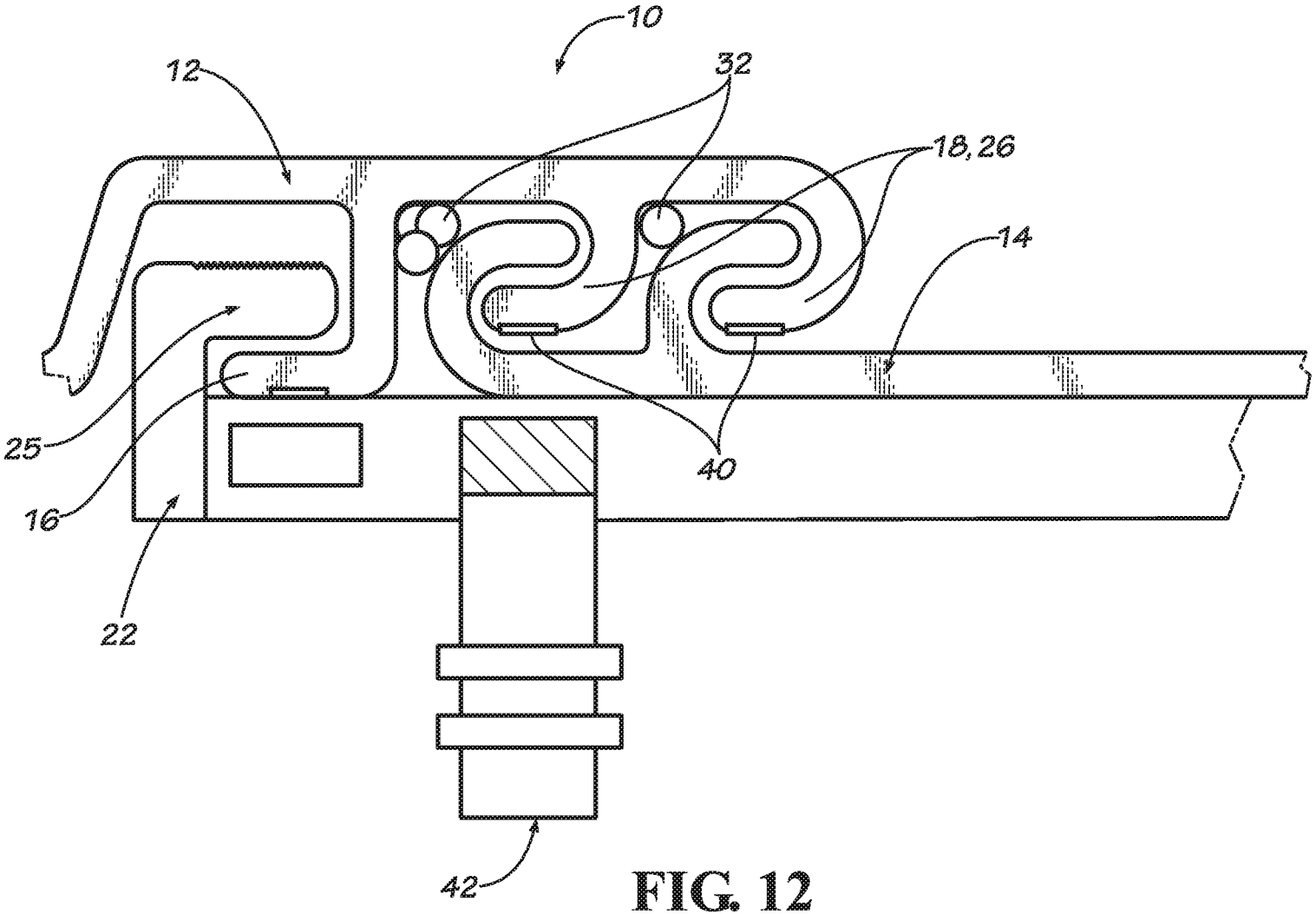
FIG. 12 is a diagram of an alternative example embodiment sheet piling carried on an alternative example embodiment mandrel, and secured to a previously-driven alternative example embodiment sheet piling.

Optionally, as depicted in FIG. 12 the sheet piling 10 can comprise one or more, and preferably a plurality of, sensor tags 40 in or on the leading edge coupling profile 12, such as for example an array of tags spaced at intervals along the length of the mandrel alignment flange 16 and/or along the length of the leading edge coupling hooks 18, 26. The sensor tags 40 can be active or passive. One or more cooperating proximity sensors 42 are optionally provided along the trailing edge pile claw of the mandrel 22 for sensing the sensor tags 40 on the previously installed piling and signaling correct or incorrect installation as the subsequent piling is installed. If the sensor 42 signals proper proximity of the mandrel to a sensor tag 40 at the toe end of the previously installed piling's mandrel alignment flange 25, it is confirmed for quality control that the coupling profiles of the pilings are engaged. Conversely, failure to sense proper proximity signals a potential failure of engagement and may indicate the need to re-install a piling. As depicted, using a set of two or three sensor tags 40, positioned at a variety of locations, helps prevent the sensor 42 from reading a false fail, for example the sheet piling 10 pulling away from the mandrel even if the profiles matched correctly. The tags 40 can alternatively be sacrificial in that they can remain on the sheet piling 10 after installation into the substrate. The corner coupling 110 embodiment described in FIG. 11 can similarly incorporate the described system of sensor tags 40 used with a mandrel sensor 42.

Figure 13A:
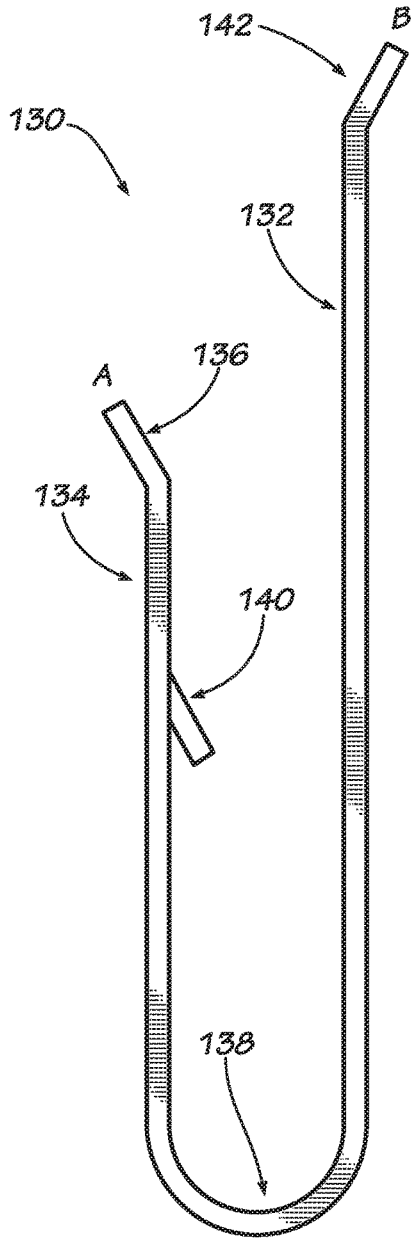
FIGS. 13A and 13B are isolated front and side views of a clip shown in FIG. 11.
Figure 13B:
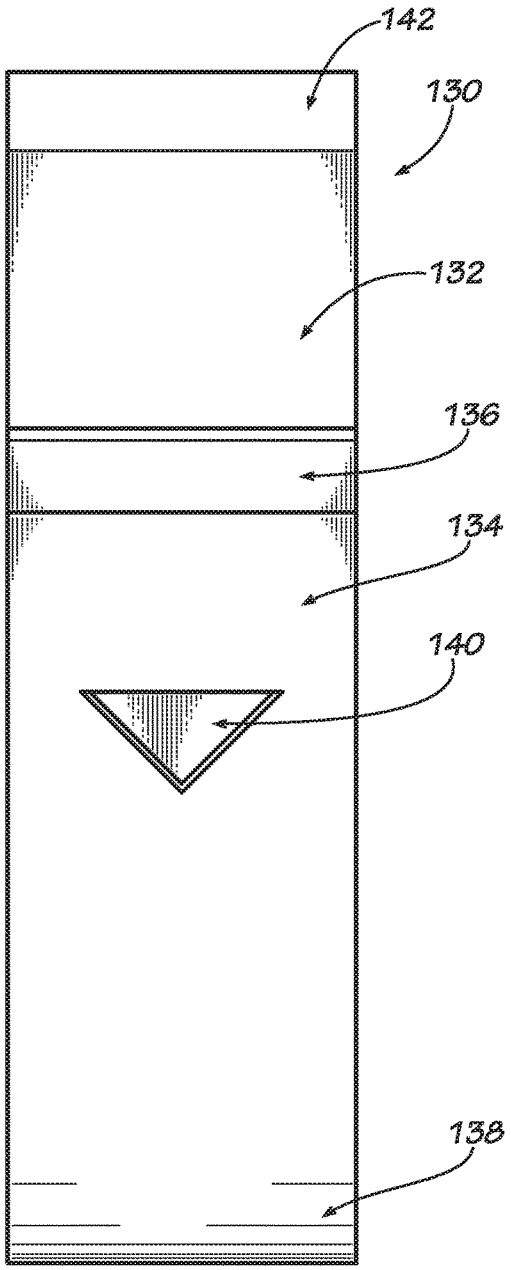

As depicted in FIGS. 11, 13A and 13B, a clip 130 can be secured over a pair of connected sheet piling coupling profiles to prevent the connected coupling profiles from disconnecting during installation with a mandrel. The example clip 130 can have a hook-shaped profile with a back flange 132 and a front flange 134 secured to each other at one proximal end by a curved trough 138. The front flange 134 and the back flange 132 are flexibly separable and are resiliently flexible towards each other. The distal free end of the back flange 132 can have a ramp 142 angled away from the front 134, and the distal free end of the front flange can have a ramp 136 angled away from the back. The front flange 134 can have a punch-out spring 140 that extends inwardly toward the back flange 132 at a predetermined angle downward in the direction of the trough 138. As depicted, the punch-out spring 140 can have a triangle shape, however alternative shapes are contemplated to be effective. In use the punch out spring 140 can slide up a sheet piling during installation, but applies a reflexive force towards the sheet piling so that it will not slip off after attachment. The punch-out spring 140 squeezes onto the sheet piling and mandrel. During installation, the front flange 134 and the back flange 132 are pushed toward each other by the substrate, causing the clip 130 to grip more tightly, but oppositely provide friction to pull the clip off with the sheet piling during extraction.

While the invention has been described with reference to preferred and example embodiments, it will be understood by those skilled in the art that a variety of modifications, additions and deletions are within the scope of the invention, as defined by the following claims.

What is claimed is:

1. A sheet piling comprising:

a body defining a top end, a toe end opposite the top end, a leading side, and a trailing side opposite the leading side, the body defining a lengthwise dimension between the top end and the toe end;

a mandrel-alignment flange and a first coupling profile extending longitudinally along the body in the lengthwise dimension along at least a portion of the leading side, and a second coupling profile extending longitudinally along the body in the lengthwise dimension along at least a portion of the trailing side; and at least one tag on the mandrel alignment flange, the tag being compatible with a sensor to confirm integrity of an attachment between sheet pilings within a multi-piling structure at a depth within a substrate.

2. The sheet piling of claim 1, wherein the first and second coupling profiles each comprise a pair of coupling flanges, and are configured for interengagement of the first coupling profile of a first sheet piling with the second coupling profile of a second sheet piling to form a multi-piling wall assembly.

3. The sheet piling of claim 1, further comprising a sealant disposed within the first coupling profile along the leading side of the sheet piling.

4. The sheet piling of claim 1, wherein the body defines a generally C-shaped cross-sectional profile, whereby a multi-piling wall assembly formed of a plurality of said sheet pilings defines a corrugated wall profile.

5. The sheet piling of claim 1, wherein the body defines a generally planar cross-sectional profile, whereby a multi-piling wall assembly formed of a plurality of said sheet pilings defines a substantially flat wall profile.

6. A multi-piling wall assembly comprising at least two sheet pilings according to claim 1, wherein the first coupling profile of a first sheet piling is slidably engaged in the lengthwise dimension with the second coupling profile of a second sheet piling.

7. An installation method for sheet pilings, comprising:

mounting a first sheet piling to a mandrel;

driving the first sheet piling into a substrate;

removing the mandrel from the substrate leaving the sheet piling in place within the substrate;

mounting a second sheet piling to the mandrel;

engaging an alignment hook of the mandrel with an alignment flange of the first sheet piling;

engaging a trailing edge coupling profile of the second sheet piling with a leading edge coupling profile of the first sheet piling;

driving the second sheet piling into the substrate with the trailing edge coupling profile of the second sheet piling remaining engaged with the leading edge coupling profile of the first sheet piling; and verifying engagement of the trailing edge coupling profile of the second sheet piling with the leading edge coupling profile of the first sheet piling at a depth within the substrate by sensing a tag of the first sheet piling with a sensor on the mandrel after driving the second sheet piling into the substrate.

8. The installation method of claim 7, wherein the trailing edge coupling profile and the leading edge coupling profile each comprise a pair of coupling hooks.

9. The installation method of claim 7, further comprising provision of a sealant within the leading edge coupling profile of the first sheet piling.

10. The installation method of claim 9, further comprising shielding the leading edge coupling profile within a protective channel of the mandrel during the step of driving the first sheet piling into the substrate so as not to displace the sealant from the leading edge coupling profile of the first sheet piling.

* * * * *